US008691031B2

(12) United States Patent
Zhao et al.

(10) Patent No.: US 8,691,031 B2
(45) Date of Patent: Apr. 8, 2014

(54) ALUMINUM ALLOY SHEET AND METHOD FOR MANUFACTURING THE SAME

(75) Inventors: Pizhi Zhao, Shizuoka (JP); Toshiya Anami, Shizuoka (JP); Ichiro Okamoto, Shizuoka (JP); Hitoshi Kazama, Saitama (JP); Kunihiro Yasunaga, Saitama (JP); Noboru Hayashi, Saitama (JP); Kevin Gatenby, Kingston (CA); Simon Barker, Kingston (CA); Edward Luce, Kingston (CA)

(73) Assignees: Nippon Light Metal Co., Ltd., Tokyo (JP); Honda Motor Co., Ltd., Tokyo (JP); Novelis Inc., Toronto (CA)

( * ) Notice: Subject to any disclaimer, the term of this patent is extended or adjusted under 35 U.S.C. 154(b) by 0 days.

(21) Appl. No.: 13/489,709

(22) Filed: Jun. 6, 2012

(65) Prior Publication Data

US 2012/0291924 A1 Nov. 22, 2012

Related U.S. Application Data

(62) Division of application No. 11/914,163, filed as application No. PCT/JP2005/010014 on May 25, 2005, now abandoned.

(51) Int. Cl.
*C22F 1/043* (2006.01)
*C22F 1/047* (2006.01)

(52) U.S. Cl.
USPC ..... 148/551

(58) Field of Classification Search
USPC ..... 148/551; 420/535
See application file for complete search history.

(56) References Cited

U.S. PATENT DOCUMENTS

| | | | | |
|---|---|---|---|---|
| 5,616,189 | A | 4/1997 | Jin et al. | |
| 6,439,451 | B1 * | 8/2002 | Kagohara et al. | 228/235.2 |
| 6,780,259 | B2 | 8/2004 | Bull et al. | |
| 2003/0059336 | A1 | 3/2003 | Aida et al. | |

FOREIGN PATENT DOCUMENTS

| | | | |
|---|---|---|---|
| JP | 2000282163 | A | 10/2000 |
| JP | 2001059124 | A | 3/2001 |
| JP | 2001262264 | A | 9/2001 |

OTHER PUBLICATIONS

International Search Report for PCT/JP2005/010014 dated Aug. 11, 2005.
Office Action for Taiwanese Patent Application No. 757553 dated Nov. 30, 2011.
Machine translation of JP2001262264A, Sep. 2001.

* cited by examiner

*Primary Examiner* — Jie Yang
(74) *Attorney, Agent, or Firm* — Heslin Rothenberg Farley & Mesiti P.C.

(57) ABSTRACT

An aluminum alloy sheet is manufactured by preparing a slab having a thickness of 5 to 15 mm with a continuous casting machine by a continuous casting process using molten alloy containing 0.40% to 0.65% of Mg, 0.50% to 0.75% of Si, 0.05% to 0.20% of Cr, and 0.10% to 0.40% of Fe, a remainder being Al; winding the slab into a coil; cold-rolling the slab into a sheet; subjecting the sheet to solution heat treatment in such a manner that the sheet is heated to a temperature of 530° C. to 560° C. at a heating rate of 10° C./sec or more and then maintained at the temperature for five seconds or more; quenching the sheet with water; coiling up the sheet; maintaining the sheet at a temperature of 60° C. to 110° C. for 3 to 12 hours; and then cooling the sheet to room temperature.

8 Claims, No Drawings

ALUMINUM ALLOY SHEET AND METHOD FOR MANUFACTURING THE SAME

CROSS REFERENCE TO RELATED APPLICATIONS

This application is a divisional application of U.S. patent application Ser. No. 11/914,163 (published as US 2009-0081072 A1 on Mar. 26, 2009), which is a national stage filing under Section 371 of PCT International Application No. PCT/JP2005/010014, filed on May 25, 2005, and published in English on Nov. 30, 2006, as WO 2006/126281 A1. The entire disclosures of each of the prior applications are hereby incorporated herein by reference.

TECHNICAL FIELD

The present invention relates to aluminum alloy sheets and methods for manufacturing such sheets. The present invention particularly relates to an aluminum alloy sheet suitable for automobile components manufactured by bending or pressing and also relates to a method for manufacturing such a sheet.

BACKGROUND ART

Sheets for automobile bodies must have high formability and strength; hence, cold-rolled steel sheets have been used for such automobile bodies. However, in order to achieve high fuel efficiency and in order to achieve weight reduction, rolled aluminum alloy sheets have been recently used. In particular, Al—Mg—Si alloy sheets are suitable for automobile bodies. This is because these alloy sheets, which have not yet been subjected to aging heat treatment, are softer and have higher formabilities such as bendability as compared with other materials. Furthermore, the alloy sheets can be increased in strength by heating the alloy sheets during a bake-painting step or another step subsequent to a forming step.

For the Al—Mg—Si alloy sheets, the following attempt has been being made: an attempt to enhance the formability by controlling the size and/or state of intermetallic compounds and/or precipitates. Furthermore, the following attempt has been being made: an attempt to enhance the bake hardenability and the formability, for example, the bendability, by appropriately tuning the composition and performing appropriate heat treatment in processes for manufacturing such alloy sheets. For example, Japanese Unexamined Patent Application Publication No. 9-31616 discloses the following technique: in order to control the size and/or state of intermetallic compounds and/or precipitates, the total Mg and Si content is kept at 2.4% or less, at least one selected from the group consisting of Mn, Cr, Zr and V is used to refine grains and stabilize microstructure, and a cast slab is homogenized, hot-rolled, cold-rolled, and subjected to solution heat treatment.

In known techniques disclosed in Japanese Unexamined Patent Application Publication No. 9-31616 and other documents, at least one selected from the group consisting of Mn, Cr, Zr and V is used to refine grains and to stabilize microstructure and a finished sheet is evaluated for the precipitation state of intermetallic compounds, stretchability, bendability, and the like. In general, alloy sheets with a total Mg and Si content of 1.5% or less have unsatisfactory bake hardenability. For such alloy sheets, the following items have not been sufficiently investigated: the influences of Mg and Si on the bake hardenability and the influence of Cr on the surface quality (orange peel), the bendability, and the size of recrystallized grains of a finished sheet. In order to enhance the bake hardenability, bendability, and surface quality (orange peel) of an aluminum alloy sheet to be processed into a finished sheet, there is a problem in that manufacturing cost is high because a step of manufacturing a slab by a DC casting process is necessary and a large number of the following steps are also necessary according to needs: a scalping step, a homogenizing step, a hot-rolling step, a cold-rolling step, an intermediate annealing step, a final-rolling step, and a final-annealing step.

DISCLOSURE OF INVENTION

It is an object of the present invention to provide an aluminum alloy sheet having high quality and methods for manufacturing such an aluminum alloy sheet with low cost.

An aluminum alloy sheet of the present invention contains 0.40% to 0.65% of Mg, 0.50% to 0.75% of Si, 0.05% to 0.20% of Cr, and 0.10% to 0.40% of Fe, the remainder being Al, those components being essential elements. The aluminum alloy sheet has a grain size of 10 to 25 μm.

The aluminum alloy sheet further contains 0.15% or less of Cu. The aluminum alloy sheet further contains 0.10% or less of Ti.

A method for manufacturing an aluminum alloy sheet according to the present invention includes the steps of preparing a slab having a thickness of 5 to 15 mm with a casting machine by a continuous casting process using molten alloy containing 0.40% to 0.65% of Mg, 0.50% to 0.75% of Si, 0.05% to 0.20% of Cr, and 0.10% to 0.40% of Fe, the remainder being Al, those components being essential elements; winding the slab into a coil; cold-rolling the resulting slab into a sheet; subjecting the resulting sheet to solution heat treatment in such a manner that the sheet is heated to a temperature of 530° C. to 560° C. at a heating rate of 10° C./sec or more and then maintained at the temperature for five seconds or more; quenching the resulting sheet with water; coiling up the resulting sheet; maintaining the resulting sheet at a temperature of 60° C. to 110° C. for a time of three to 12 hours; and then cooling the resulting sheet to room temperature.

A method for manufacturing an aluminum alloy sheet according to the present invention includes the steps of preparing a slab having a thickness of 5 to 15 mm with a continuous casting machine by a continuous casting process using molten alloy containing 0.40% to 0.65% of Mg, 0.50% to 0.75% of Si, 0.05% to 0.20% of Cr, and 0.10% to 0.40% of Fe, the remainder being Al, those components being essential elements; winding the slab into a coil; cold-rolling the resulting slab into a sheet; subjecting the resulting sheet to solution heat treatment in such a manner that the sheet is heated to a temperature of 530° C. to 560° C. at a heating rate of 10° C./sec or more and then maintained at the temperature for five seconds or more; cooling the resulting sheet to a temperature of 70° C. to 115° C.; coiling up the resulting sheet; and then cooling the resulting sheet to room temperature at a cooling rate of 10° C./hour or less.

A method for manufacturing an aluminum alloy sheet according to the present invention includes the steps of preparing a slab having a thickness of 10 to 30 mm with a continuous casting machine by a continuous casting process using molten alloy containing 0.40% to 0.65% of Mg, 0.50% to 0.75% of Si, 0.05% to 0.20% of Cr, and 0.10% to 0.40% of Fe, the remainder being Al, those components being essential elements; hot-rolling the slab into a hot-rolled sheet having a thickness of 2 to 8 mm; winding the hot-rolled sheet into a coil; cold-rolling the resulting hot-rolled sheet into a cold-rolled sheet; subjecting the cold-rolled sheet to solution heat treatment in such a manner that the sheet is heated to a temperature of 530° C. to 560° C. at a heating rate of 10° C./sec or more and then maintained at the temperature for five seconds or more; quenching the resulting sheet with water; coiling up the resulting sheet; maintaining the resulting sheet at a temperature of 60° C. to 110° C. for a time of three to 12 hours; and then cooling the resulting sheet to room temperature.

A method for manufacturing an aluminum alloy sheet according to the present invention includes the steps of preparing a slab having a thickness of 10 to 30 mm with a continuous casting machine by a continuous casting process using molten alloy containing 0.40% to 0.65% of Mg, 0.50% to 0.75% of Si, 0.05% to 0.20% of Cr, and 0.10% to 0.40% of Fe, the remainder being Al, those components being essential elements; hot-rolling the slab into a hot-rolled sheet having a thickness of 2 to 8 mm; winding the hot-rolled sheet into a coil; cold-rolling the resulting hot-rolled sheet into a cold-rolled sheet; subjecting the cold-rolled sheet to solution heat treatment in such a manner that the sheet is heated to a temperature of 530° C. to 560° C. at a heating rate of 10° C./sec or more and then maintained at the temperature for five seconds or more; cooling the resulting sheet to a temperature of 70° C. to 115° C.; coiling up the resulting sheet; and then cooling the resulting sheet to room temperature at a cooling rate of 10° C./hour or less.

In any one of the above methods for manufacturing an aluminum alloy sheet, the molten alloy further contains 0.15% or less of Cu. The molten alloy further contains 0.10% or less of Ti. Furthermore, the cold-rolling step is performed with a reduction ratio of 20% or more per pass.

Since the aluminum alloy sheet has the above configuration and the methods for manufacturing the sheet include the above steps, the sheet can be manufactured with low cost although the sheet has high quality.

BEST MODE FOR CARRYING OUT THE INVENTION

An aluminum alloy sheet according to the present invention and methods for manufacturing such an aluminum alloy sheet according to the present invention will now be described. First, the aluminum alloy sheet of the present invention that can be used for automobile bodies will now be described. The inventors have performed various investigations and then found that the quality of the aluminum alloy sheet, that is, properties such as bake hardenability, bendability, and surface quality (orange peel) can be enhanced by tuning the composition of the aluminum alloy sheet and the size of grains as described below. Furthermore, the inventors have found that manufacturing cost can be reduced because the manufacturing method can be simplified.

After the aluminum alloy sheet is subjected to solution heat treatment, Mg forms a solid solution in the matrix. Mg precipitates together with Si to form a precipitation hardening phase during a heating step for baking a coating, thereby enhancing the strength. When the Mg content is less than 0.40 percent by weight, the precipitation hardening effect is low. When the Mg content is more than 0.65 percent by weight, the aluminum alloy sheet subjected to solution heat treatment has unsatisfactory bendability, which cannot be improved. Therefore, the Mg content ranges from 0.40 percent to 0.65 percent by weight. In order to achieve excellent bendability after the aluminum alloy sheet is subjected to solution heat treatment, the Mg content preferably ranges from 0.40 percent to 0.60 percent by weight.

Si precipitates together with Mg to form an $Mg_2Si$ intermediate phase referred to as a β" phase or the precipitation hardening phase similar to such a phase during a heating step for baking a coating, thereby enhancing the strength. When the Si content is less than 0.50 percent by weight, the precipitation hardening effect is low. When the Si content is more than 0.75 percent by weight, the aluminum alloy sheet subjected to solution heat treatment has unsatisfactory bendability, which cannot be improved. Therefore, the Si content ranges from 0.50 percent to 0.75 percent by weight. In order to achieve excellent bendability after the aluminum alloy sheet is subjected to solution heat treatment, the Si content preferably ranges from 0.60 percent to 0.70 percent by weight.

Cr is a component to refine recrystallized grains. When the Cr content is less than 0.05 percent by weight, the refining effect is insufficient. When the Cr content is more than 0.20 percent by weight, the formabilities, such as bendability, of the aluminum alloy sheet can not be improved sufficiently to manufacture automobiles, because coarse Al—Cr intermetallic compounds are formed during slab casting. Therefore, the Cr content ranges from 0.05 percent to 0.20 percent by weight. This allows the crystallized grain size to be controlled within the range of 10 to 25 μm to improve surface quality (orange peel). In order to achieve further improvement of formability such as bendability and further improvement of surface quality (orange peel), the Cr content preferably ranges from 0.05 percent to 0.15 percent by weight.

Fe coexisting with Si and Cr promotes the formation of an Al—Fe—Si intermetallic compound and/or an Al—(Fe/Cr)—Si intermetallic compound having a size of 5 μm or less during a casting step to create a large number of recrystallization nucleation sites. An increase in the number of the recrystallization nucleus leads to a small recrystallized grain size, thereby improving surface quality (orange peel). When the Fe content is less than 0.10 percent by weight, the effect of the improvement of surface quality (orange peel) is insufficient. When the Fe content is more than 0.40 percent by weight, the aluminum alloy sheet has formabilities, such as bendability, insufficient to manufacture automobiles because coarse Al—Fe—Si intermetallic compounds and/or Al—(Fe/Cr)—Si intermetallic compounds are formed during slab casting but the final sheet has low bake hardenability due to a reduction in the content of Si solid solution in a thin slab; hence, formabilities such as bendability and bake hardenability are low. Therefore, the Fe content ranges from 0.10 percent to 0.40 percent by weight. In order to improve formabilities such as bendability and bake hardenability, the Fe content preferably ranges from 0.10 percent to 0.30 percent by weight.

In addition to Mg, Si, Cr, and Fe that are essential components, in order to achieve high quality, the aluminum alloy sheet may contain 0.15% or less of Cu depending on properties necessary for the aluminum alloy sheet. Cu is a component to promote age hardening to enhance the strength of a product subjected to bake painting. When the Cu content is more than 0.15%, the aluminum alloy sheet has high yield strength after the sheet is subjected to pre-aging treatment, that is, T4P treatment; hence, the sheet has not only unsatisfactory formabilities such as bendability but has seriously low corrosion resistance, particularly filiform corrosion resistance, that is, the quality of the sheet is low. Therefore, the Cu content is 0.15% or less.

In addition to Mg, Si, Cr, and Fe that are essential components, in order to achieve high quality, the aluminum alloy sheet may contain 0.10% or less of Ti depending on properties necessary for the aluminum alloy sheet. Examples of a grain refiner of a thin slab include Al—Ti and Al—Ti—B. When the Ti content is 0.10 percent by weight or less, casting defects can be prevented from being formed in slabs without sacrificing advantages of the present invention; therefore, the quality of the aluminum alloy sheet can be further enhanced. When the Ti content is more than 0.10 percent by weight, coarse intermetallic compounds such as $TiAl_3$ are formed during a casting step; therefore, the aluminum alloy sheet has unsatisfactory formability. Thus, the Ti content is set to 0.10 percent by weight or less when Ti is employed.

The remainder other than the components described above includes Al and unavoidable impurities. The aluminum alloy sheet with the composition specified above has a grain size of 10 to 25 μm; hence, the surface quality (orange peel) is improved.

A method for manufacturing the aluminum alloy sheet will now be described. Examples of a continuous slab casting process described below include various processes such as a twin-belt casting process and a twin-drum casting process. For the continuous slab casting process, molten metal is poured between stacked water-cooled rotary belts or rotary drums and then solidified by cooling the belt faces of drum faces, whereby a thin slab is manufactured; the resulting slab is pulled out of a portion between the belts or drums, the portion being opposite to a section into which the molten metal has been poured; and the resulting slab is then hot-rolled according to needs or directly coiled. Various casting processes similar to the continuous slab casting process can be used.

In the method for manufacturing the aluminum alloy sheet according to the present invention, a slab is manufactured by the continuous slab casting process using molten alloy having the same composition as that of the aluminum alloy sheet. The slab is continuously manufactured with a continuous slab-casting machine for the continuous slab casting process and then hot-rolled according to needs or directly wound into a roll. The slab has a thickness of 5 to 30 mm; therefore, the slab surface is cooled at a rate of 200° C./sec or more and a portion spaced from the slab surface at a distance equal to one fourth of the slab thickness is cooled at a rate of 30° C./sec to 150° C./sec during the casting step. In the metal microstructure of the finished sheet, the Al—Fe—Si intermetallic compounds and/or Al—(Fe/Cr)—Si intermetallic compounds have a very fine size, for example, about 5 μm or less. In the aluminum alloy sheet manufactured by the method of the present invention, the intermetallic compounds are hardly torn from the matrix when the sheet is formed; hence, the aluminum alloy sheet is superior in formability as compared with rolled sheets manufactured by a DC casting process, the rolled sheets being apt to crack due to forming.

Since the cooling rate during the casting step is relatively high and the Mg content and Si content of the alloy are relatively low, the amount of the $Mg_2Si$ intermetallic compounds is less as compared with DC cast slabs.

It is known that dislocation pile-up occurs around the intermetallic compounds during a cold-rolling step to create recrystallization nucleation sites during an annealing step. When the slab has a thickness of 5 to 30 mm, the slab surface can be cooled at a rate of 200° C./sec or more and a portion spaced from the slab surface at a distance equal to one fourth of the slab thickness can be cooled at a rate of 30° C./sec to 150° C./sec during the casting step; hence, the Al—Fe—Si intermetallic compounds and/or Al—(Fe/Cr)—Si intermetallic compounds of the finished sheet have a very fine size, for example, about 5 μm or less. Furthermore, the number of the intermetallic compounds per unit volume is large and the density of recrystallization grain nuclei is therefore high. Recrystallized grains have a relatively small size, for example, 10 to 25 μm because the growth in the recrystallized grain size is prevented by the pinning effect of preventing grain boundaries from migrating. Accordingly, the aluminum alloy sheet has satisfactory formability and surface quality (orange peel).

A procedure for evaluating the surface quality (orange peel) is as follows: the formed aluminum alloy sheet is treated by an electrodeposition coating process and then visually inspected whether the resulting sheet has random strain marks. In the aluminum alloy sheet of the present invention, since the recrystallized grains have a size of 10 to 25 μm as described above, the aluminum alloy sheet is superior in surface quality (orange peel) than known aluminum alloy sheets.

In the continuous slab casting process, any slab having a thickness of less than 5 mm can hardly manufactured with the continuous slab casting machine because the amount of aluminum passing through the casting machine per unit time is too small. When the slab thickness is more than 30 mm, the cooling rate of a portion spaced from the slab surface at a distance equal to one fourth of the slab thickness is less than 30° C./sec during the casting step; therefore, the Al—Fe—Si intermetallic compounds and/or the Al—(Fe/Cr)—Si intermetallic compounds have a size of more than 5 μm depending on the alloy composition. Thus, the intermetallic compounds can be separated from the matrix in some cases when the finished sheet is formed, that is, the sheet has unsatisfactory formabilities such as bendability.

When the slab has a thickness of more than 15 mm to 30 mm or less, the slab is hot-rolled into a sheet having a thickness of 2 to 8 mm after the continuous casting step and the hot-rolled sheet is then wound into a roll, and the hot-rolled sheet is then cold-rolled so as to have a thickness equal to that of the finished sheet. When the slab has a thickness of 10 mm or more to 15 mm or less, the slab may be hot-rolled into a sheet having a thickness of 2 to 8 mm after the continuous casting step and the hot-rolled sheet is then wound into a roll, and the hot-rolled sheet is then cold-rolled so as to have a thickness equal to that of the finished sheet. Alternatively, when the slab has a thickness of 10 mm or more to 15 mm or less, the slab may be directly coiled up after the continuous casting step, and the coiled slab is then cold-rolled so as to have a thickness equal to that of the finished sheet. When the slab has a thickness of 5 mm or more to less than 10 mm, the slab is directly coiled up after the continuous casting step, and the coiled slab is then cold-rolled so as to have a thickness equal to that of the finished sheet.

The cast slab is hot-rolled in the hot-rolling step according to needs or directly coiled up as described above, and the hot-rolled sheet or the coiled slab is then cold-rolled in a cold-rolling step so as to have a thickness equal to that of the finished sheet. It is known that an increase in the reduction ratio per pass of the cold-rolling step enhances the bendability and bake hardenability of the finished sheet. The observation of cross sections of cold-rolled sheets, prepared at different reduction ratios per pass, having a thickness equal to that of the finished sheet has resulted in the discovery that an increase in reduction ratio per pass increases the plastic deformation per pass of a slab and the Al—Fe—Si intermetallic compounds and/or Al—(Fe/Cr)—Si intermetallic compounds and the $Mg_2Si$ intermetallic compounds formed in the casting step are readily fragmented. Therefore, the formation of solid solutions in the matrix by these intermetallic compounds is probably promoted during solution heat treatment subsequent to the cold-rolling step, whereby the bendability and the bake hardenability are enhanced.

If the aluminum alloy sheet must have higher quality depending on requirements for the aluminum alloy sheet, the reduction ratio per pass may be 20% or more. This enhances the bendability and the bake hardenability to improve the quality of the aluminum alloy sheet. If the reduction ratio per pass is 25% or more, the bendability and the bake hardenability are further enhanced, whereby the quality of the aluminum alloy sheet is further improved.

After cold-rolling, the cold-rolled sheet is subjected to solution heat treatment, whereby the sheet is pre-aged. The solution heat treatment and cooling treatment subsequent thereto are preferably performed with an ordinary continuous annealing furnace, that is, a CAL. If the solution heat treatment and the subsequent cooling treatment are performed with the CAL, the sheet can be pre-aged during the solution heat treatment and the subsequent cooling treatment such that nuclei for β" precipitation are formed, whereby an Al—Mg—Si alloy sheet with high bake hardenability can be obtained. In particular, the cold-rolled sheet is subjected to the solution heat treatment in such a manner that the sheet is heated to a temperature of 530° C. to 560° C. at a heating rate of 10° C./sec or more and then maintained at the temperature for five seconds or more. The resulting sheet is treated as follows: (1) the sheet is quenched, coiled up, maintained at a temperature of 60° C. to 110° C. for a time of three to 12 hours, and then cooled to room temperature; or (2) the sheet is cooled to a temperature of 70° C. to 115° C., coiled up, and then cooled to room temperature at a cooling rate of 10° C./hour or less.

When the temperature of the solution heat treatment performed using the annealing furnace is less than 530° C., the $Mg_2Si$ intermetallic compounds do not sufficiently form solid solutions in the matrix; therefore, the finished sheet has low bake hardenability, that is, the bake hardenability cannot be enhanced. In contrast, when the retention temperature is more than 560° C., the $Mg_2Si$ intermetallic compounds can be partly melted, that is, burning can occur, in some cases. Furthermore, course recrystallized grains having a size of more than 25 μm are formed and the finished sheet has unsatisfactory surface quality (orange peel), that is, the surface quality (orange peel) cannot be enhanced. Thus, in order to improve bake hardenability and surface quality (orange peel), the temperature of the solution heat treatment performed using the annealing furnace ranges from 530° C. to 560° C.

When the retention time of the annealing furnace is less than five seconds, the $Mg_2Si$ intermetallic compounds do not sufficiently form solid solutions in the matrix; therefore, the finished sheet has low bake hardenability, that is, the bake hardenability cannot be enhanced. Thus, in order to achieve high bake hardenability, the retention time of the annealing furnace is five seconds or more.

In addition, when the heating rate during the continuous annealing treatment is less than 10° C./sec, coarse grains are formed; therefore, the finished sheet has inferior formabilities such as bendability and unsatisfactory surface quality (orange peel), that is, formabilities such as bendability and the surface quality (orange peel) cannot be enhanced. When the cooling rate is less than 10° C./sec, Si precipitates at grain boundaries; therefore, the bake hardenability and the bendability are deteriorated, that is, the bake hardenability and the bendability cannot be enhanced. In order to enhance the quality of the aluminum alloy sheet by improving formabilities such as bendability, the surface quality (orange peel), and the bake hardenability, the heating rate during the continuous annealing treatment is 10° C./sec or more. Furthermore, the cooling rate during the continuous annealing treatment is preferably 10° C./sec or more.

After the cold-rolled sheet is subjected to the solution heat treatment, the sheet is water-quenched and then coiled up. Alternatively, the sheet is cooled and then coiled up. In the case that the sheet is water-quenched and then coiled up after the solution heat treatment, when the temperature of the pre-aging treatment subsequent to the solution heat treatment, that is, the retention temperature, is less than 60° C., it takes a long time to enhance the bake hardenability, that is, it is difficult to enhance the bake hardenability. When the retention temperature is more than 110° C., the yield strength is increased and the bendability is deteriorated, that is, the bendability cannot be enhanced because an $Mg_2Si$ intermediate phase, referred to as β", or a precipitation hardening phase similar thereto is formed during the pre-aging treatment although the $Mg_2Si$ intermediate phase must be formed in the bake painting step. In order to improve the quality of the aluminum alloy sheet by enhancing the bake hardenability and the bendability, the temperature of the pre-aging treatment subsequent to the solution heat treatment ranges from 60° C. to 110° C.

When the retention time of the pre-aging treatment subsequent to the solution heat treatment is less than three hours, high bake hardenability cannot be achieved. In contrast, when the retention time is more than 12 hours, the yield strength is increased and the bendability is deteriorated, that is, the bendability cannot be enhanced because the $Mg_2Si$ intermediate phase, referred to as β", or the precipitation hardening phase similar thereto is formed during the pre-aging treatment although the $Mg_2Si$ intermediate phase must be formed in the bake painting step. Therefore, in order to improve the quality of the aluminum alloy sheet by enhancing the bake hardenability and the bendability, the retention time of the pre-aging treatment subsequent to the solution heat treatment ranges from three to 12 hours.

On the other hand, in the case that the cold-rolled sheet is subjected to the solution heat treatment, cooled, and then coiled up, when the temperature of the coiling-up step is less than 70° C., it takes a long time to achieve high bake hardenability, that is, it is difficult to enhance the bake hardenability. In contrast, when the temperature of the coiling-up step is more than 115° C., the yield strength is increased and the bendability is deteriorated, that is, the bendability cannot be enhanced, because the $Mg_2Si$ intermediate phase, referred to as β", or the precipitation hardening phase similar thereto is formed during the cooling step and the coiling-up step although the $Mg_2Si$ intermediate phase must be formed in the bake painting step. When the cooling rate of the coiled-up sheet is more than 10° C./hour, the bake hardenability is decreased, that is, the bake hardenability cannot be enhanced. In order to improve the quality of the aluminum alloy sheet by enhancing the bake hardenability and the bendability, the temperature of the coiling-up step ranges 70° C. to 115° C. and the cooling rate of the coiled-up sheet is 10° C./hour or less.

As described above, the aluminum alloy sheet of the present invention contains 0.40% to 0.65% of Mg, 0.50% to 0.75% of Si, 0.05% to 0.20% of Cr, and 0.10% to 0.40% of Fe, the remainder being Al, those components being essential elements. The aluminum alloy sheet has a grain size of 10 to 25 μm. Therefore, the aluminum alloy sheet has satisfactory bake hardenability, bendability, and surface quality (orange peel), that is, the aluminum alloy sheet has high quality. Since the aluminum alloy sheet has the composition described above, the sheet can be manufactured by a method of the present invention as follows: a slab is prepared by a continuous casting process and then hot-rolled according to needs; the slab or the hot-rolled sheet is coiled and then cold-rolled;

the cold-rolled sheet is subjected to solution heat treatment, water-quenched, coiled up, pre-aged, and then cooled to room temperature. Alternatively, the sheet can be manufactured by another method of the present invention as follows: a slab is prepared by a continuous casting process and then hot-rolled according to needs; the slab or the hot-rolled sheet is coiled and then cold-rolled; the cold-rolled sheet is subjected to solution heat treatment, cooled to a temperature within a predetermined range, coiled up, and then annealed to room temperature. Since the methods of the present invention do not include any scalping step, homogenizing step, and intermediate annealing step, the methods are lower in manufacturing cost as compared with known manufacturing methods. Thus, the aluminum alloy sheet of the present invention has high quality and can be manufactured by a method of the present invention with low cost.

EXAMPLES

Evaluation results of the aluminum alloy sheet manufactured by the method of the present invention will now be described. In Examples below, samples treated in a cold-rolling step are not coils but cut sheets. In order to simulate a continuous annealing step in which a coil is treated with a CAL, each sample was subjected to solution heat treatment in a salt bath and water-quenched or quenched with 85° C. water. In order to simulate an annealing step or a reheating step subsequent to a coiling-up step, each sample was cooled and heat-treated in an annealer.

Example 1

Molten alloy containing the following components was manufactured: 0.54% of Mg, 0.66% of Si, 0.10% Cr, 0.15% of Fe, and 0.01% of Ti, the remainder being Al and unavoidable impurities. The molten alloy was processed into a thin slab having a thickness of 10 mm with a twin-belt casting machine by a continuous casting process. The thin slab was cold-rolled at a reduction ratio of 30% per pass so as to have a thickness of 1 mm, whereby a cold-rolled sheet was prepared. The cold-rolled sheet was subjected to solution heat treatment by maintaining the sheet at 560° C. for 15 seconds in a salt bath. The resulting sheet was immediately water-quenched and then heat-treated, that is, pre-aged, at 85° C. for eight hours in an annealer. The resulting sheet was cooled to room temperature and then allowed to stand for one week. The resulting sheet was processed into finished sheets that have not yet bake-painted, that is, T4P-treated sheets. Some of the T4P-treated sheets were aged at 180° C. for one hour in an annealer, whereby T6P-treated sheets were prepared.

Example 2

T4P-treated sheets and T6P-treated sheets were prepared in the same manner as that described in Example 1 except that molten alloy containing the following components was used: 0.46% of Mg, 0.66% of Si, 0.10% Cr, 0.16% of Fe, and 0.02% of Ti, the remainder being Al and unavoidable impurities.

Example 3

T4P-treated sheets and T6P-treated sheets were prepared in the same manner as that described in Example 1 except that molten alloy containing the following components was used: 0.46% of Mg, 0.66% of Si, 0.10% Cr, 0.16% of Fe, 0.01% of Ti, and 0.12% of Cu, the remainder being Al and unavoidable impurities.

Comparative Example 1

T4P-treated sheets and T6P-treated sheets were prepared in the same manner as that described in Example 1 except that molten alloy containing the following components was used: 0.64% of Mg, 0.85% of Si, 0.17% of Fe, 0.01% of Ti, and 0.01% of Cu, the remainder being Al and unavoidable impurities.

Comparative Example 2

T4P-treated sheets and T6P-treated sheets were prepared in the same manner as that described in Example 1 except that molten alloy containing the following components was used: 0.68% of Mg, 0.74% of Si, 0.10% Cr, 0.16% of Fe, and 0.01% of Ti, the remainder being Al and unavoidable impurities.

Comparative Example 3

A slab having a size of 1100 mm×500 mm×4000 mm was prepared with an ordinary DC casting machine by a semi-continuous casting process using molten alloy containing 0.59% of Mg, 0.73% of Si, 0.10% of Cr, 0.15% of Fe, and 0.01% of Ti, the remainder being Al and unavoidable impurities. After both faces of the slab were scalped, the resulting slab was maintained at 550° C. for ten hours in a holding furnace, whereby the slab was homogenized. The resulting slab was taken out of the holding furnace and then hot-rolled with a hot-rolling machine so as to have a thickness of 6 mm, whereby a hot-rolled sheet was prepared. The hot-rolled sheet was coiled up, cooled, and then cold-rolled at a reduction ratio of 30% per pass with a cold-rolling machine so as to have a thickness of 2 mm. The resulting sheet was subjected to intermediate annealing treatment and then further cold-rolled so as to have a thickness of 1 mm, whereby a cold-rolled sheet was prepared. T4P-treated sheets and T6P-treated sheets were prepared using the cold-rolled sheet in the same manner as that described in Example 1.

Comparative Example 4

T4P-treated sheets and T6P-treated sheets were prepared in the same manner as that described in Example 1 except that molten alloy having the same composition as that described in Example 2 was used and a sheet was cold-rolled at a reduction ratio of 10% per pass so as to have a thickness of 1 mm.

Table 1 shows the compositions of Alloys A to F used to prepare the aluminum alloy sheets of Examples 1 to 3 and Comparative Examples 1 to 4, respectively.

TABLE 1

Alloy Composition

| | Alloy Composition (% on a weight basis) | | | | | |
|---|---|---|---|---|---|---|
| Alloy | Mg | Si | Fe | Cu | Cr | Ti |
| A | 0.54 | 0.66 | 0.15 | — | 0.10 | 0.01 |
| B | 0.46 | 0.66 | 0.16 | — | 0.10 | 0.02 |
| C | 0.46 | 0.66 | 0.16 | 0.12 | 0.10 | 0.01 |
| D | 0.64 | 0.85 | 0.17 | 0.01 | — | 0.01 |
| E | 0.68 | 0.74 | 0.16 | — | 0.10 | 0.01 |
| F | 0.59 | 0.73 | 0.15 | — | 0.10 | 0.01 |

The aluminum alloy sheets of Examples 1 to 3 and Comparative Examples 1 to 4 were subjected to a tensile test at room temperature and evaluated for bake hardenability, bendability, surface quality (orange peel), and grain size. The tensile test was performed for the T4P-treated sheets and the T6P-treated sheets. A difference in 0.2% yield strength between each T4P-treated sheet and T6P-treated sheet was used as an index of bake hardenability. Each aluminum alloy sheet having an index of bake hardenability of 90 MPa is evaluated to be superior in bake hardenability. The T4P-treated sheets were evaluated for bendability, grain size, and surface quality (orange peel). The bendability was evaluated as follows: each T4P-treated sheet was strained by 5% in advance and then bent into a 180° angle with the ratio r/t=0.5, cracks in a bent potion were visually inspected, and a rating of 1, 1.5, 2, 3, 4, or 5 was given to the T4P-treated sheet. Each T4P-treated sheet having a rating of 2 or less is evaluated to be superior in bendability. The grain size was determined by observing a cross section of a portion spaced from a surface of each T4P-treated sheet at a distance equal to one fourth of the thickness thereof by a cross cut method, the cross section being parallel to the rolling direction. The surface quality (orange peel) was evaluated as follows: each T4P-treated sheet was stretched, subjected to electrodeposition, and then visually inspected for appearance. A rating of "A" was given to each T4P-treated sheet having good appearance and a rating of "B" was given to each T4P-treated sheet having inferior appearance. Evaluation results are shown in Table 2.

TABLE 2

Manufacturing Process and Properties

| | Alloy | Reduction Ratio per Pass of Cold-rolling Step (%) | T4P 0.2% YS (MPa) | T4P UTS (MPa) | T4P EL (%) | T6P 0.2% YS (MPa) | B.H. (MPa) | Bendability (rating) | G.S. (μm) | Surface quality (orange peel) |
|---|---|---|---|---|---|---|---|---|---|---|
| Example 1 | A | 30 | 97 | 200 | 27 | 196 | 99 | 2 | 17 | A |
| Example 2 | B | 30 | 95 | 190 | 29 | 192 | 97 | 1.5 | 20 | A |
| Example 3 | C | 30 | 98 | 195 | 30 | 210 | 112 | 2 | 19 | A |
| Comparative Example 1 | D | 30 | 124 | 242 | 24 | 234 | 110 | 5 | 32 | B |
| Comparative Example 2 | E | 30 | 112 | 221 | 27 | 225 | 113 | 3 | 18 | A |
| Comparative Example 3 | F | 30 | 110 | 223 | 28 | 207 | 97 | 2 | 35 | B |
| Comparative Example 4 | B | 10 | 87 | 188 | 29 | 174 | 87 | 2 | 22 | A |

Examples 1, 2, and 3 according to the present invention each show that the index of bake hardenability is 90 MPa or more, the rating of bendability is 2 or less, and the surface quality (orange peel) is good, that is, the bake hardenability, bendability, and surface quality (orange peel) are superior.

Comparative Example 1 shows that the grain size is more than 25 μm and the surface quality (orange peel) is unsatisfactory. This is because the aluminum alloy sheet of this comparative example does not contain Cr. Furthermore, since the Si content is 0.85%, that is, the Si content is more than 0.75%, each T4P-treated sheet of this comparative example has a large 0.2%-yield strength and the rating of bendability is 5, that is, the rating is inferior. Comparative Example 2 shows that the rating of bendability is 3, that is, the rating is inferior. This is because the Mg content is 0.68%, that is, the Mg content is greater than 0.65% and each T4P-treated sheet of this comparative example therefore has a large 0.2%-yield strength. Comparative Example 3 shows that the grain size is more than 25 μm and the surface quality (orange peel) is unsatisfactory. This is because the aluminum alloy sheet of this comparative example has been prepared using the slab prepared by the DC casting process. Comparative Example 4 shows that the index of bake hardenability is 87 MPa, that is, the index is less than 90 MPa. This is because the aluminum alloy sheet of this comparative example has been prepared at a reduction ratio of 10% per pass, that is, a reduction ratio of less than 20% per pass, in the cold-rolling step.

Example 4

A thin slab with a thickness of 10 mm was prepared with a twin-belt casting machine by a continuous casting process using molten alloy having the same composition as that described in Example 1. The thin slab was cold-rolled at a reduction ratio of 30% per pass so as to have a thickness of 1 mm, whereby a cold-rolled sheet was prepared. The cold-rolled sheet was subjected to solution heat treatment in such a manner that the sheet was maintained at 560° C. for 15 seconds in a salt bath. The resulting sheet was immediately water-quenched and then directly reheat-treated, that is, pre-aged, at 85° C. for eight hours in an annealer. The resulting sheet was cooled to room temperature and then allowed to stand for one week. The resulting sheet was processed into finished sheets that have not yet bake-painted, that is, T4P-treated sheets. Some of the T4P-treated sheets were aged at 180° C. for one hour in an annealer, whereby T6P-treated sheets were prepared.

Comparative Example 5

A cold-rolled sheet was prepared in the same manner as that described in Example 4 and then subjected to solution heat treatment by maintaining the sheet at 515° C. for 15 seconds in a salt bath. The resulting sheet was water-quenched and then pre-aged under the same conditions as those described in Example 4. T4P-treated sheets and T6P-treated sheets were prepared using the resulting sheet.

Comparative Example 6

A cold-rolled sheet was prepared in the same manner as that described in Example 4 and then subjected to solution heat treatment by maintaining the sheet at 560° C. for 15 seconds in a salt bath. The resulting sheet was immediately water-quenched and then reheat-treated, that is, pre-aged, at 50° C. for eight hours in an annealer. Subsequently, T6P-treated sheets were prepared using the resulting sheet under the same conditions as those described in Example 4.

Comparative Example 7

A cold-rolled sheet was prepared in the same manner as that described in Example 4 and then subjected to solution heat treatment by maintaining the sheet at 560° C. for 15 seconds in a salt bath. The resulting sheet was immediately water-quenched and then reheat-treated, that is, pre-aged, at 120° C. for eight hours in an annealer. Subsequently, T6P-treated sheets were prepared using the resulting sheet under the same conditions as those described in Example 4.

Comparative Example 8

A cold-rolled sheet was prepared in the same manner as that described in Example 4 and then subjected to solution heat treatment by maintaining the sheet at 560° C. for 15 seconds in a salt bath. The resulting sheet was immediately water-quenched and then reheat-treated, that is, pre-aged, at 85° C. for two hours in an annealer. Subsequently, T6P-treated sheets were prepared using the resulting sheet under the same conditions as those described in Example 4.

Comparative Example 9

A cold-rolled sheet was prepared in the same manner as that described in Example 4 and then subjected to solution heat treatment by maintaining the sheet at 560° C. for 15 seconds in a salt bath. The resulting sheet was immediately water-quenched and then reheat-treated, that is, pre-aged, at 85° C. for 16 hours in an annealer. Subsequently, T6P-treated sheets were prepared using the resulting sheet under the same conditions as those described in Example 4.

The aluminum alloy sheets, which were subjected to the solution heat treatment using a salt bath under different conditions or subjected to the heat treatment using an annealer under different conditions as described above, were subjected to a tensile test at room temperature in the same manner as that described in Example 1. Furthermore, the aluminum alloy sheets were evaluated for bake hardenability, bendability, surface quality (orange peel), and grain size. Test and evaluation results are shown in Table 3.

Example 4 shows that the index of bake hardenability is 90 MPa or more, the rating of bendability is two or less, and the surface quality (orange peel) is good, that is, the bake hardenability, bendability, and surface quality (orange peel) are superior as compared with the comparative examples.

In contrast, Comparative Example 5 shows that the index of bake hardenability is 85 MPa, that is, the index is less than 90 MPa and is unsatisfactory. This is because the temperature of the solution heat treatment is 515° C., which is too low, and $Mg_2Si$ intermetallic compounds do not therefore form solid solutions in the matrix sufficiently. Comparative Example 6 shows that the index of bake hardenability is 87 MPa, that is, the index is less than 90 MPa and is unsatisfactory. This is because the reheating temperature is 50° C., that is, the reheating temperature is less than 60° C., and pre-aging effects cannot therefore be achieved. Comparative Example 7 shows that the rating of bendability is four, that is, the bendability is unsatisfactory. This is because the reheating temperature is 120° C., that is, the reheating temperature is more than 110° C., and a T4P-treated sheet has therefore high 0.2%-yield strength. Comparative Example 8 shows that the index of bake hardenability is 89 MPa, that is, the index is unsatisfactory. This is because the reheating time is two hours, that is, the reheating time is less than three hours, and pre-aging effects cannot therefore be achieved sufficiently. Comparative Example 9 shows that the rating of bendability is three, that is, the bendability is unsatisfactory. This is because the reheating time is 16 hours, that is, the reheating time is more than 12 hours, and a T4P-treated sheet therefore has high 0.2%-yield strength.

TABLE 3

Manufacturing Process and Properties

| | Alloy | Reduction Ratio per Pass of Cold-rolling Step (%) | Temperature of Solution Heat Treatment (° C.) | Reheating Tempera-ture (° C.) | Reheating Time (hours) | T4P 0.2% YS (MPa) | T4P UTS (MPa) | T4P EL (%) | T6P 0.2% YS (MPa) | B.H. (MPa) | Bendability (rating) | G.S. (μm) | Surface quality (orange peel) |
|---|---|---|---|---|---|---|---|---|---|---|---|---|---|
| Example 4 | A | 30 | 560 | 85 | 8 | 97 | 200 | 27 | 196 | 99 | 2 | 17 | A |
| Comparative Example 5 | A | 30 | 515 | 85 | 8 | 82 | 187 | 27 | 167 | 85 | 1.5 | 14 | A |
| Comparative Example 6 | A | 30 | 560 | 50 | 8 | 90 | 190 | 28 | 177 | 87 | 1.5 | 17 | A |
| Comparative Example 7 | A | 30 | 560 | 120 | 8 | 123 | 212 | 28 | 224 | 101 | 4 | 17 | A |
| Comparative Example 8 | A | 30 | 560 | 85 | 2 | 89 | 188 | 27 | 178 | 89 | 1.5 | 17 | A |
| Comparative Example 9 | A | 30 | 560 | 85 | 16 | 112 | 214 | 27 | 208 | 96 | 3 | 17 | A |

Example 5

A thin slab with a thickness of 10 mm was prepared with a twin-belt casting machine by a continuous casting process using molten alloy having the same composition as that described in Example 1. The thin slab was cold-rolled at a reduction ratio of 30% per pass so as to have a thickness of 1 mm, whereby a cold-rolled sheet was prepared. The cold-rolled sheet was subjected to solution heat treatment by maintaining the sheet at 560° C. for 15 seconds in a salt bath. The resulting sheet was immediately quenched with 85° C. water, placed in an annealer with an atmospheric temperature of 85° C., cooled at a cooling rate of 5° C./hour, and then allowed to stand for one week. The resulting sheet was processed into finished sheets that have not yet bake-painted, that is, T4P-treated sheets. Some of the T4P-treated sheets were aged at 180° C. for one hour in an annealer, whereby T6P-treated sheets were prepared.

Comparative Example 10

A cold-rolled sheet prepared in the same manner as that described in Example 5 was subjected to solution heat treatment in such a manner that the sheet was maintained at 510° C. for 15 seconds in a salt bath. The resulting sheet was immediately quenched with 85° C. water, placed in an annealer with an atmospheric temperature of 85° C., cooled under the same conditions as those described in Example 5, allowed to stand for one week, and then processed into T4P-treated sheets and T6P-treated sheets.

Comparative Example 11

A cold-rolled sheet was subjected to solution heat treatment under the same conditions as those described in Example 5. The resulting sheet was immediately quenched with 85° C. water, placed in an annealer with an atmospheric temperature of 120° C., cooled under the same conditions as those described in Example 5, allowed to stand for one week, and then processed into T4P-treated sheets and T6P-treated sheets.

Comparative Example 12

A cold-rolled sheet was subjected to solution heat treatment under the same conditions as those described in Example 5. The resulting sheet was immediately quenched with 50° C. water, placed in an annealer with an atmospheric temperature of 50° C., cooled under the same conditions as those described in Example 5, allowed to stand for one week, and then processed into T4P-treated sheets and T6P-treated sheets.

Comparative Example 13

A cold-rolled sheet was subjected to solution heat treatment under the same conditions as those described in Example 5. The resulting sheet was immediately quenched with 85° C. water, placed in an annealer with an atmospheric temperature of 85° C., cooled at a cooling rate of 15° C./hour, allowed to stand for one week, and then processed into T4P-treated sheets and T6P-treated sheets.

The aluminum alloy sheets, which were prepared by varying the cooling rate and the initial atmospheric temperature of each annealer that corresponds to the coiling-up temperature as described above, were subjected to a tensile test at room temperature in the same manner as that described in Example 1. Furthermore, the aluminum alloy sheets were evaluated for bake hardenability, bendability, surface quality (orange peel), and grain size. Test and evaluation results are shown in Table 4.

Example 5 shows that the index of bake hardenability is 90 MPa or more, the rating of bendability is two or less, and the surface quality (orange peel) is good, that is, the bake hardenability, bendability, and surface quality (orange peel) are superior as compared with the comparative examples.

In contrast, Comparative Example 10 shows that the index of bake hardenability is 88 MPa, that is, the index is less than 90 MPa. This is because the temperature of the solution heat treatment is 510° C., which is too low, and $Mg_2Si$ intermetallic compounds do not therefore form solid solutions in the matrix sufficiently. Comparative Example 11 shows that the rating of bendability is four, that is, the bendability is unsatisfactory. This is because the initial atmospheric temperature of the annealer is 120° C., which is too high, and a T4P-treated sheet therefore has high 0.2%-yield strength. Comparative Example 12 shows that the index of bake hardenability is 76 MPa, that is, the index is less than 90 MPa. This is because the initial atmospheric temperature of the annealer is 50° C., that is, the initial atmospheric temperature is less than 70° C., and pre-aging effects cannot therefore be achieved sufficiently. Comparative Example 13 shows that the index of bake hardenability is 81 MPa, that is, the index is less than 90 MPa. This is because the cooling rate is 15° C./hour, that is, the cooling rate is more than 10° C./hour, and pre-aging effects cannot therefore be achieved sufficiently.

TABLE 4

Manufacturing Process and Properties

| | Alloy | Reduction Ratio per Pass of Cold-rolling Step (%) | Temperature of Solution Heat Treatment (° C.) | Initial Temperature of Annealer (° C.) | Cooling Rate (° C./hour) | T4P 0.2% YS (MPa) | T4P UTS (MPa) | T4P EL (%) | T6P 0.2% YS (MPa) | B.H. (MPa) | Bendability (rating) | G.S. (μm) | Surface quality (orange peel) |
|---|---|---|---|---|---|---|---|---|---|---|---|---|---|
| Example 5 | A | 30 | 560 | 85 | 5 | 92 | 192 | 28 | 189 | 97 | 2 | 17 | A |
| Comparative Example 10 | A | 30 | 510 | 85 | 5 | 85 | 189 | 28 | 173 | 88 | 2 | 15 | A |
| Comparative Example 11 | A | 30 | 560 | 120 | 5 | 121 | 202 | 26 | 217 | 96 | 4 | 17 | A |
| Comparative Example 12 | A | 30 | 560 | 50 | 5 | 89 | 192 | 28 | 165 | 76 | 2 | 17 | A |
| Comparative Example 13 | A | 30 | 560 | 85 | 15 | 88 | 190 | 27 | 169 | 81 | 2 | 17 | A |

Example 6

Molten alloy containing the following components was manufactured: 0.55% of Mg, 0.66% of Si, 0.10% Cr, 0.18% of Fe, and 0.02% of Ti, the remainder being Al and unavoidable impurities. The molten alloy was processed into a thin slab having a thickness of 16 mm with a twin-belt casting machine by a continuous casting process. The thin slab was rolled by a hot-rolling machine so as to have a thickness of 5.5 mm and then cold-rolled at a reduction ratio of 30% per pass so as to have a thickness of 1 mm, whereby a cold-rolled sheet was prepared. The cold-rolled sheet was subjected to solution heat treatment in such a manner that the sheet was maintained at 560° C. for 15 seconds in a salt bath. The resulting sheet was immediately water-quenched and then heat-treated, that is, pre-aged, at 85° C. for eight hours in an annealer. The resulting sheet was cooled to room temperature and then allowed to stand for one week. The resulting sheet was processed into finished sheets that have not yet bake-painted, that is, T4P-treated sheets. Some of the T4P-treated sheets were aged at 180° C. for one hour in an annealer, whereby T6P-treated sheets were prepared.

Comparative Example 14

T4P-treated sheets and T6P-treated sheets were prepared in the same manner as that described in Example 6 except that molten alloy containing the following components was used: 0.64% of Mg, 0.85% of Si, 0.17% of Fe, and 0.01% of Ti, the remainder being Al and unavoidable impurities.

Comparative Example 15

T4P-treated sheets and T6P-treated sheets were prepared in the same manner as that described in Example 6 except that molten alloy containing the following components was used: 0.55% of Mg, 0.95% of Si, 0.15% of Fe, and 0.01% of Ti, the remainder being Al and unavoidable impurities.

Table 5 shows the compositions of Alloys G, H, and I used to prepare the aluminum alloy sheets of Example 6 and Comparative Examples 14 and 15, respectively. Table 6 shows test results obtained by subjecting the aluminum alloy sheets of Example 6 and Comparative Examples 14 and 15, as well as those of Examples 1 to 3 and Comparative Examples 1 to 4, to a tensile test at room temperature and also shows results of evaluating the aluminum alloy sheets of Example 6 and Comparative Examples 14 and 15 for bake hardenability, bendability, surface quality (orange peel), and grain size.

Example 6 shows that the index of bake hardenability is 90 MPa or more, the rating of bendability is two or less, and the surface quality (orange peel) is good, that is, the bake hardenability, bendability, and surface quality (orange peel) are superior as compared with the comparative examples.

In contrast, Comparative Examples 14 and 15 each show that the grain size is more than 25 μm and the surface quality (orange peel) is inferior. This is because the aluminum alloy sheets of Comparative Examples 14 and 15 do not contain Cr. Furthermore, Comparative Examples 14 and 15 each show that the rating of bendability is five, that is, the bendability is unsatisfactory. This is because the Si content is more than 0.75%, which is too high.

TABLE 5

| Alloy Composition | | | | | |
|---|---|---|---|---|---|
| | Alloy Composition (% on a weight basis) | | | | |
| Alloy | Mg | Si | Fe | Cr | Ti |
| G | 0.55 | 0.66 | 0.18 | 0.10 | 0.02 |
| H | 0.64 | 0.85 | 0.17 | — | 0.01 |
| I | 0.55 | 0.95 | 0.15 | — | 0.01 |

TABLE 6

| Manufacturing Process and Properties | | | | | | | | | | | | | |
|---|---|---|---|---|---|---|---|---|---|---|---|---|---|
| | | Reduction Ratio per Pass of Cold-rolling | Temperature of Solution Heat | Reheating Temperature | Reheating | T4P | | | T6P | | | | Surface quality |
| | Alloy | Step (%) | Treatment (° C.) | (° C.) | Time (hours) | 0.2% YS (MPa) | UTS (MPa) | EL (%) | 0.2% YS (MPa) | B.H. (MPa) | Bendability (rating) | G.S. (μm) | (orange peel) |
| Example 6 | G | 30 | 560 | 85 | 8 | 102 | 200 | 28 | 200 | 98 | 2 | 19 | A |
| Comparative Example 14 | H | 30 | 560 | 85 | 8 | 112 | 218 | 26 | 248 | 136 | 5 | 38 | B |
| Comparative Example 15 | I | 30 | 560 | 85 | 8 | 111 | 214 | 26 | 246 | 135 | 5 | 54 | B |

The invention claimed is:

1. A method for manufacturing an aluminum alloy sheet, comprising the steps of preparing a slab having a thickness of 5 to 15 mm with a continuous casting machine by a continuous casting process using molten alloy containing following components: 0.40% to 0.65% of Mg, 0.50% to 0.75% of Si, 0.05% to 0.20% of Cr, and 0.10% to 0.40% of Fe, a remainder being Al, said components being essential elements; winding the slab into a coil; cold-rolling the slab into a sheet; subjecting the sheet to solution heat treatment in such a manner that the sheet is heated to a temperature of 530° C. to 560° C. at a heating rate of 10° C./sec or more and then maintained at the temperature for five seconds or more; quenching the sheet with water; coiling up the sheet; maintaining the sheet at a temperature of 60° C. to 110° C. for a time of three to 12 hours; and then cooling the sheet to room temperature, wherein the cold-rolling step is performed with a reduction ratio of 20% or more per pass in order to obtain an aluminum alloy sheet having an average grain size of 10 to 20 μm, and having a yield strength of 102 MPa or less.

2. A method for manufacturing an aluminum alloy sheet according to claim 1, wherein the molten alloy further contains 0.15% or less of Cu and/or 0.10% or less of Ti.

3. A method for manufacturing an aluminum alloy sheet, comprising the steps of preparing a slab having a thickness of 5 to 15 mm with a continuous casting machine by a continuous casting process using molten alloy containing following components: 0.40% to 0.65% of Mg, 0.50% to 0.75% of Si, 0.05% to 0.20% of Cr, and 0.10% to 0.40% of Fe, a remainder being Al, said components being essential elements; winding the slab into a coil; cold-rolling the slab into a sheet; subjecting the sheet to solution heat treatment in such a manner that the sheet is heated to a temperature of 530° C. to 560° C. at a heating rate of 10° C./sec or more and then maintained at the temperature for five seconds or more; cooling the sheet to a temperature of 70° C. to 115° C.; coiling up the sheet; and then cooling the sheet to room temperature at a cooling rate of 10° C./hour or less, wherein the cold-rolling step is performed with a reduction ratio of 20% or more per pass in order to obtain an aluminum alloy sheet having an average grain size of 10 to 20 μm, and having a yield strength of 102 MPa or less.

4. A method for manufacturing an aluminum alloy sheet according to claim 3, wherein the molten alloy further contains 0.15% or less of Cu and/or 0.10% or less of Ti.

5. A method for manufacturing an aluminum alloy sheet, comprising the steps of preparing a slab having a thickness of 10 to 30 mm with a continuous casting machine by a continuous casting process using molten alloy containing following components: 0.40% to 0.65% of Mg, 0.50% to 0.75% of Si, 0.05% to 0.20% of Cr, and 0.10% to 0.40% of Fe, a remainder being Al, said components being essential elements; hot-rolling the slab into a hot-rolled sheet having a thickness of 2 to 8 mm; winding the hot-rolled sheet into a coil; cold-rolling the hot-rolled sheet into a cold-rolled sheet; subjecting the cold-rolled sheet to solution heat treatment in such a manner that the sheet is heated to a temperature of 530° C. to 560° C. at a heating rate of 10° C./sec or more and then maintained at the temperature for five seconds or more; quenching the sheet with water; coiling up the sheet; maintaining the sheet at a temperature of 60° C. to 110° C. for a time of three to 12 hours; and then cooling the sheet to room temperature, where the cold-rolling step is performed with a reduction ratio of 20% or more per pass in order to obtain an aluminum alloy sheet having an average grain size of 10 to 20 μm, having a yield strength of 102 MPa or less.

6. A method for manufacturing an aluminum alloy sheet according to claim 5, wherein the molten alloy further contains 0.15% or less of Cu and/or 0.10% or less of Ti.

7. A method for manufacturing an aluminum alloy sheet, comprising the steps of preparing a slab having a thickness of 10 to 30 mm with a continuous casting machine by a continuous casting process using molten alloy containing following components: 0.40% to 0.65% of Mg, 0.50% to 0.75% of Si, 0.05% to 0.20% of Cr, and 0.10% to 0.40% of Fe, a remainder being Al, said components being essential elements; hot-rolling the slab into a hot-rolled sheet having a thickness of 2 to 8 mm; winding the hot-rolled sheet into a coil; cold-rolling the hot-rolled sheet into a cold-rolled sheet; subjecting the cold-rolled sheet to solution heat treatment in such a manner that the sheet is heated to a temperature of 530° C. to 560° C. at a heating rate of 10° C./see or more and then maintained at the temperature for five seconds or more; cooling the resulting sheet to a temperature of 70° C. to 115° C.; coiling up the sheet; and then cooling the sheet to room temperature at a cooling rate of 10° C. our or less, wherein the cold-rolling step is performed with a reduction ratio of 20% or more per pass in order to obtain an aluminum alloy sheet having an average grain size of 10 to 20 μm, and having a yield strength of 102 MPa or less.

8. A method for manufacturing an aluminum alloy sheet according to claim 7, wherein the molten alloy further contains 0.15% or less of Cu and/or 0.10% or less of Ti.

* * * * *

UNITED STATES PATENT AND TRADEMARK OFFICE

CERTIFICATE OF CORRECTION

PATENT NO. : 8,691,031 B2
APPLICATION NO. : 13/489709
DATED : April 8, 2014
INVENTOR(S) : Pizhi Zhao et al.

It is certified that error appears in the above-identified patent and that said Letters Patent is hereby corrected as shown below:

In the Claims:

Column 20, Line 20: Claim 7, Delete "10° C. our" and insert -- 10° C./hour --

Signed and Sealed this
Seventeenth Day of June, 2014

Michelle K. Lee

Michelle K. Lee
*Deputy Director of the United States Patent and Trademark Office*